US006126894A

United States Patent [19]

Moxson

[11] Patent Number: 6,126,894

[45] Date of Patent: Oct. 3, 2000

[54] METHOD OF PRODUCING HIGH DENSITY SINTERED ARTICLES FROM IRON-SILICON ALLOYS

[75] Inventor: Vladimir S. Moxson, 2525 Deer Hollow, Hudson, Ohio 44236

[73] Assignee: Vladimir S. Moxson, Hudson, Ohio

[21] Appl. No.: 09/285,975

[22] Filed: Apr. 5, 1999

[51] Int. Cl.[7] ..... B22F 3/16

[52] U.S. Cl. ..... 419/2; 419/31; 419/32; 419/39; 419/47

[58] Field of Search ..... 419/2, 31, 32, 419/39, 47

[56] References Cited

U.S. PATENT DOCUMENTS

| | | | |
|---|---|---|---|
| 3,950,166 | 4/1976 | Obara et al. | 419/23 |
| 4,251,273 | 2/1981 | Smith et al. . | |
| 4,265,681 | 5/1981 | Krause et al. | 148/111 |
| 4,612,162 | 9/1986 | Morgan et al. | 419/28 |
| 4,885,133 | 12/1989 | Fujii | 419/29 |
| 4,891,080 | 1/1990 | Delcorso et al. | 148/326 |
| 4,956,011 | 9/1990 | Nishida et al. | 419/10 |
| 5,476,632 | 12/1995 | Shivanath et al. | 419/57 |
| 5,516,483 | 5/1996 | Shivanath et al. | 419/14 |
| 5,540,883 | 7/1996 | Jones et al. | 419/28 |
| 5,641,922 | 6/1997 | Shivanath et al. | 75/231 |

OTHER PUBLICATIONS

Frayman, L. I., et al., "Modified P/M Soft Magnetic Materials for Automotive Applications," *Int. J. of Powder Metallurgy*, v. 34, No. 7, p. 31, 1998.

"Warm Compacting Technology for High Density P/M Parts," *Int. J. of Powder Metallurgy*, v. 32, No. 1, p. 9, 1996.

Zvonarev, B. B., et al., "Improvements of Properties of Sintered Materials Made from Duchte Powders", Powder Metallurgy, Minsk, No. 18, p. 33, 1995.

Lefebvre, L–P., et al. "Particle Bonding During Heat Treatment of Green Compacts Intended for A/C Soft Magnetic Applications," *Int. J. of Powder Metallurgy*, v. 34, No. 7, p. 51, 1998.

*Primary Examiner*—George Wyszomierski

[57] ABSTRACT

A method of producing Iron-Silicon high density sintered articles of intricate design comprising: (a) the blending of compressible iron or low-carbon steel powder, silicon alloyed iron or silicon powder, or combination of silicon alloyed iron and silicon powder, and lubricant, (b) cold pressing said blended mixture with pressures of less than 50 tsi to form the structure of said article with the density up to 88% of the theoretical value and with uniformly distributed hard powder consisting of silicon and/or silicon alloyed particles among ductile iron powder, (c) low temperature stress relieving heat treatment of said formed article at the temperature range of 360–800° C. followed by a cooling rate of less than 120° C./min that relieves compression stress in said iron or low carbon steel particles and provides partial bonding of these iron/steel particles inside said formed article but does not allow the substantial diffusion of silicon from hard powder consisting of silicon and/or silicon alloyed particles into ductile iron or steel particles, (d) impregnation or lubrication of said formed articles which provide hydrostatic pressure and radial plastic flow of the porous metal in a subsequent pressing operation, (e) densification of said formed article, stress relieved, and impregnated article by cold pressing to the density not less than 91% of the theoretical density using the same pressure as in the previous pressing stage, and finally (f) sintering the said formed article to obtain a density greater than 96% of the theoretical value at the elevated temperature up to 1420° C. from 1250° C.

9 Claims, 2 Drawing Sheets

METHOD OF PRODUCING HIGH DENSITY SINTERED ARTICLES FROM IRON-SILICON ALLOYS

FIELD OF INVENTION

This invention relates to a method of producing high density sintered articles from metal powders and particularly relates to a process of forming intricately shaped articles from iron-silicon alloys having a density higher than 96% of the theoretical value by blending metal powders, cold pressing in rigid dies, and sintering at a high temperature in a reducing atmosphere, vacuum and/or a combination of reducing atmosphere and vacuum.

BACKGROUND OF THE INVENTION

The powder metallurgy technology has many advantages over traditional metalworking production: cost, energy, and material efficiency, high volume capability, net shape forming without machining, etc. However, sintered metal articles often rank below cast and wrought metals in some physical and mechanical properties. Relatively low density is usually the main drawback of sintered metals that results in insufficient properties of production, and retards a wider distribution of the powder metallurgy technology. Another problem is the inability to provide a radial flow of the porous metal in open dies in the second pressing operation. High density of sintered articles is absolutely necessary in such structurally sensitive applications as magnetic materials, particularly in articles sintered from iron-silicon powder alloys.

Many of these iron-silicon sintered articles have an intricate design that is characterized by a combination of thin and thick intersections, local radial changes of the shape, and tight dimensional tolerances. A uniform distribution of the density and the chemical composition in the volume of articles is also required. The specific shape of these iron-silicon articles requires the use of precise tooling for powder compacting (die and punch) that will not withstand pressure much higher than 50 tsi and allows to reach the maximum green density over 6.8 g/cc (88% of theoretical value). On the other hand, those iron-silicon sintered articles are in mass production and their manufacturing should not be expensive. Therefore, the cold pressing on automatic presses with rigid dies is the most preferable process for the iron-silicon powder compaction. Further densification of the article body to the value over 7.4 g/cc should occur during the high temperature sintering in order to achieve the required properties.

Various techniques have been developed to increase the density of powdered articles to near theoretical. "Double press double sintering" method is the most popular among them. But this method is not applicable to iron-silicon powder alloys because the hardness of the sintered article is so high after the first cycle of sintering, that any significant densification in cold pressing during the second molding cycle is impossible and no radial material flow may be achieved.

Pure iron and low carbon steel powders for powder metallurgy are used in the production of sintered parts usually having a green density of 6.0–7.2 g/cc (76–92% of the theoretical value). These parts are being made by mixing iron powder with copper and graphite powders, and the like, shaping into a green compact in a mold, sintering, and if necessary, sizing a sintered body for dimensional correction.

However, the sintered body produced by adding copper powder, graphite powder or the like to the iron powder is high in the strength, so that the drawback is that the dimensional correction can not be conducted to a satisfactory extent due to spring-back of the sintered body even if the sizing for the dimensional correction is made.

But, as we have stated above, any reasonable densification in sizing after the sintering is impossible for iron-silicon articles for reason of their hardness and brittleness. Besides, any copper and/or graphite admixtures to the iron-silicon composition cannot be tolerated because they significantly deteriorate all magnetic properties.

Most other conventional densification methods, such as Hot Isostatic Pressing, warm pressing, preliminary pulverization of powders, or special pre-alloying of iron powder, are also not suitable for the production of soft magnetic iron-silicon articles because some of these methods cause excessive manufacturing expenses and others contaminate the magnetic material with impermissible impurities.

The process of producing high density sintered alloys as disclosed in the U.S. Pat. No. 5,516,483 comprises a blending of initial powders such as compressible iron powder, carbon, ferro alloys and lubricant, pressing said blended mixture to the shape in a single compacting stage. Then, the formed article can be sintered at a temperature higher than 1300° C. The single step of the compaction obtained in this proposed method occurs between 6.5 to 6.8 g/cc. Authors of this invention reported the final density of the article being as high as 7.3 g/cc and even 7.7 g/cc. This is the result of separate grinding of ferro alloy powders to a particle size 8–12 microns and of sintering at a temperature that is significantly higher than in other conventional methods. It means that the shrinkage during the sintering provides the densification from 0.5 to 0.9 g/cc. This high densification in the sintering stage adversely affects the final tolerances of article sizes, especially for complicated shape parts.

Such extreme densification at the cost of sintering only is impossible for iron-silicon compacted alloys consisting of silicon more than 3 wt. % because the liquid-phase sintering of these alloys occurs only during the first minutes of the sintering process at the constant temperature. As the interaction between solid iron powder and silicon-rich liquid phase is being developed, the liquidus temperature of the molten alloy drastically increases (as it is known from previous trials and clearly demonstrated on the Fe—Si Phase Diagram). Further processing occurs as the solid-phase sintering is characterized by substantially lower shrinkage. Moreover, the master alloy, that is usually used in the initial blend for the production of iron-silicon magnetic articles, has about 31 wt. % of silicon and consists of more than 50% of $\epsilon$-phase (FeSi intermetallics) that is melted only at a temperature greater than 1410° C. In other words, the liquid-phase sintering is never realized completely in the temperature range of 1250–1380° C. that is used for sintering according to U.S. Pat. Nos. 5,516,483, 5,540,883, and 5,476,632. We need to obtain substantially greater green density of iron-silicon compacted articles, for instance 7.0–7.1 g/cc instead of 6.5–6.8 g/cc, in order to reach the final density level over 7.4 g/cc (96% of theoretical value) after sintering. Besides, the higher green density will provide better dimensional tolerances of the articles after their sintering. But the method described in U.S. Pat. Nos. 5,516,483, 5,540,883, and 5,476,632 as well as all conventional methods designed in other referred patents do not offer a solution how to reach the density greater than 6.8 g/cc after cold pressing iron-silicon articles having intricate shapes.

Accordingly, it is the principal object of the present invention to provide a method of producing iron-silicon soft magnetic sintered articles of intricate design which articles exhibit a uniform density greater than 88% of the theoretical value (6.8 g/cc) before the sintering and the final density of sintered articles greater than 96% of the theoretical value (7.4 d/cc).

A further objective of this invention is to provide a cost effective method for producing iron-silicon sintered articles having a density level that is mentioned above by means of automatic cold presses and a single sintering operation.

SUMMARY OF THE INVENTION

The invention advantageously solves the above problems and provides the final density of iron-silicon articles greater than 96% of the theoretical value and uniform distribution over the complicated shape of the article without impairing productivity and manufacturing costs.

In one aspect, the present invention concerns a process of producing high density iron-silicon sintered articles of intricate design which process comprises:

(a) the blending of compressible iron or low-carbon steel powder, silicon alloyed iron or silicon powder or combination of silicon alloyed iron and silicon powder, lubricant, and with or without a flow rate improving agent, (b) cold pressing said blended mixture with pressure less than 50 tsi to form the structure of said article with the density up to 88% of the theoretical value and with uniformly distributed hard powder particles consisting of silicon and/or silicon alloyed particles among ductile iron powder, (c) low temperature stress relieving heat treatment of said formed article at the temperature range of 360–800° C. followed by a cooling rate of less than 120° C./min that provides relief of compression stress in said iron or low carbon steel particles and partial bonding of these iron/steel particles inside said formed article but does not allow the substantial diffusion of silicon from hard powder consisting of silicon and/or silicon alloyed particles into ductile iron or steel particles. In addition to the stress relieving, the durable heating below the temperature of $\alpha \rightarrow \gamma$ phase transformation results in a partial bonding of iron or low carbon steel particles. A partial bonding of iron or low carbon steel particles occurs during this operation because diffusion is more active in the body-centered $\alpha$-phase lattice than in the face-centered austenitic lattice.

The temperature can be elevated temporarily during this heat treatment above the temperature of $\alpha \rightarrow \gamma$ phase transformation of said iron or low carbon steel powder to enhance partial solid-phase bonding of said powder and then the temperature is reduced below the temperature of to the $\alpha \leftarrow \gamma$ phase transformation to continue the said stress relieving heat treatment. This allows to obtain the uniform distribution of the body density on the next cold pressing operation because iron particles joined together provide a hydrostatic flow of the material under pressure, (d) impregnation or lubrication of said formed articles by liquid (natural or synthetic oil, and the like) provide hydrostatic pressure and radial plastic flow of the porous metal in the subsequent pressing operation and tooling lubrication, (e) densification of said formed and stress relieved article by cold pressing in closed or opened die to the density not less than 91% of the theoretical value using the same pressure as in the previous pressing stage, and finally (f) sintering the said formed article to obtain a density greater than 96% of the theoretical value that is carried out at the permanently elevated temperature up to 1420° C. from 1250° C.

In another aspect, the present invention relates to sintered iron-silicon articles having a density approaching theoretical which are produced by a cost effective method from powders by means of automatic cold presses and a single sintering operation. This method comprises:

(a) the blending of 10±1 wt. % of iron-silicon master alloy consisting 31±1 wt. % of silicon and 89±1 wt. % of low-carbon steel powder and consisting, by weight percent, less than 0.1 carbon, 0.15–0.20 manganese, 0.08–0.12 copper, 0.03–0.06 nickel, 0.08–0.12 chromium, and the balance of iron and incidental impurities of oxygen, nitrogen, phosphorus, and sulfur, with lubricant, and flow rate improving agent. 3 weight percent of silicon in the final composition can be achieved by using an elemental silicon or a combination of elemental silicon and iron silicon master alloy, (b) cold pressing said blended mixture with pressures less than 50 tsi to form the structure of said article with the density up to 88% of the theoretical value and with uniformly distributed hard powder particles consisting of silicon and/or silicon alloyed particles among ductile iron powder, (c) low temperature stress relieving heat treatment of said formed article at a temperature range of 360–800° C. followed by a cooling rate of less than 120° C./min that provides relief of compression stress in said iron or low carbon steel particles and partial bonding of these iron/steel particles inside said formed article but does not allow the substantial diffusion of silicon from hard powder consisting of silicon and/or silicon alloyed particles into ductile iron or steel particles. The temperature can be elevated temporarily during this heat treatment above the temperature of $\alpha \rightarrow \gamma$ phase transformation of said iron or low carbon steel powder to enhance partial solid-phase bonding of the said powder and then the temperature is reduced below the temperature of $\alpha \leftarrow \gamma$ phase transformation to continue the said stress relieving heat treatment.

(d) impregnation or lubrication of said formed articles which provide hydrostatic pressure and radial plastic flow of the porous metal in the subsequent pressing operation and tooling lubrication, (e) densification of said formed and stress relieved article by cold pressing on automatic press with the pressure 20–50 tsi to the density not less than 91% of the theoretical value, and finally (f) sintering the said formed article to obtain a density greater than 96% of the theoretical value that is carried out in two stages: liquid-phase sintering at a temperature from 1280 to 1300° C., and solid-phase sintering at a temperature range of 1300–1420° C.

The permanent elevation of the temperature progressively every 8–12 minutes for 15–20° C. on each step is another accomplishment of the sintering operation that is a little bit more costly but more effective concerning the increasing density.

DESCRIPTION OF THE PREFERRED EMBODIMENT

In practice, the article of the invention is produced from at least two types of powder metals: iron or low carbon steel powder and iron-silicon master alloy consisting of about 31 wt. % of silicon. The full composition of low carbon steel will be presented below in detailed examples but we should say that the concentration of carbon must be as minimal as possible and the concentration of other elements would be limited by 0.1 or 0.2 wt. % in order to not impair magnetic properties of sintered iron-silicon articles. Generally speaking, the use of low carbon steel is justified only from cost considerations because the use of the pure iron powder is the most preferable in this technology in providing the best magnetic properties of sintered articles. Preferably, that 60–80 wt. % of both metal powders would have the particle size below 100 mesh (149 microns). Both metal powders (taken in the approximate ratio 9:1) are blended together with a regular lubricant and with or without the flow rate improving agent in any standard conventional blender.

Figure 1:
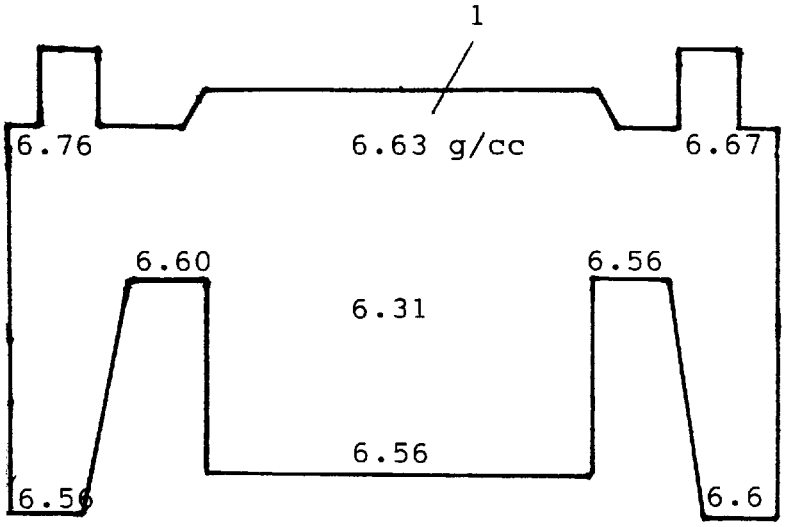
FIG. 1 shows a sample of the cross section of formed iron-silicon article and the distribution of the green density after the first cold pressing operation.

The blended mixture having appropriate apparent density (around 3.0 g/cc) and flow rate (around 26 sec/50 grams) is pressed in rigid die under the pressure from 20 to 50 tsi depending on the design of article and tooling. One typical cross section of iron-silicon articles is shown in FIG. 1. Green density of the formed article is up to 6.8 g/cc (88% of the theoretical value). The distribution of the density 1 through the article cross section is demonstrated in FIG. 1. Such non-uniform distribution of the density along the height must be improved using the process of the present invention.

Strong residual stresses are concentrated mainly in ductile particles of iron or low carbon steel after the said cold pressing because these particles occupy about 90% of the article volume, and they have a hardness about 4 times less than powder particles consisting of silicon. In other words, said iron or steel particles have from 3 to 4 times less yield point and modulus of plasticity. Therefore, just the deformation of this ductile powder allows to obtain higher densification from 3.0 to 6.0–6.8 g/cc on the first cold pressing operation. On the other hand, just strong residual compression stress in said iron or steel particles restrict further compression of the article that could be reached. Besides, an absence of interparticle bonding prevents a radial flow of metal in the molding operation.

In order to relieve said residual stresses and allow further densification of the article, this invention put in a special heat technology treatment at the temperature range of 360–800° C. that relieves compression stress in said iron or low carbon steel particles inside the formed article, creates a partial surface diffusion among iron particles, but does not allow substantial diffusion of silicon from hard powder consisting of silicon into ductile iron or steel particles.

In addition to the stress relieving, the durable heating below the temperature of $\alpha \rightarrow \gamma$ phase transformation results in a partial bonding of iron or low carbon steel particles. A partial bonding of iron or low carbon steel particles occurs during this operation because diffusion is more active in the body-centered $\alpha$-phase crystal lattice than in the face-centered $\gamma$-phase lattice. An important point is that the temperature and temporal cycle of this heat treatment is not sufficient for active diffusion exchange between silicon and iron.

This heat treatment operation can be completed by temporarily increasing the heating temperature above that of $\alpha \rightarrow \gamma$ phase transformation of said iron or low carbon steel powder to enhance a partial solid-phase bonding of said powder and then the temperature is then reduced below the temperature of $\alpha \leftarrow \gamma$ phase transformation to continue the said stress relieving heat treatment. Such additional thermal shock activates a diffusion interaction between all iron or low carbon steel particles that are in the contact with each other after compacting. Two rearrangements of the crystal lattice of iron sharply intensify the diffusion interaction between contacting surfaces, and all iron particles form indissoluble connections inside of the article body. This allows to obtain the uniform distribution of the body density and the radial plastic flow in the next cold pressing operation because iron particles joined together provide a hydrostatic flow of the material under pressure.

The inventor has totally examined many experimental results and confirmed that the diffusion of silicon from hard powder consisting of silicon into ductile iron or steel particles is practically insignificant at the temperature below 800° C. This circumstance is very important in order to prevent the alloying of iron by silicon during the time of said stress relieving heat treatment. If we would permit the significant alloying of iron particles by silicon, the hardness and the modulus of plasticity of article body would rise so much after the heat treatment that further cold pressing and densification would be impossible or very hampered. The target of said heat treatment is only the stress relief of all iron or low carbon steel particles that occupy about 90% of the article volume in order to make them ductile again and allow the next cold pressing operation of the article. Heating above the temperature of $\alpha \rightarrow \gamma$ phase transformation of iron for only 1–10 minutes is insufficient to provide significant mass exchange between iron and silicon particles, since all diffusion processes take time.

The cooling rate after stress relieving heat treatment should be less than 120° C./min to prevent a thermal shock and undesirable dimensional change of formed articles. The higher temperature of the heat treatment, the less cooling rate should follow. Practically, the holding temperature and the cooling rate of said heat treatment depend on the value of furnace loading and the article design. The inventor has tested many modes of the stress relieving heat treatment and confirmed that the average cooling rate can be around 30° C./min after the heat treatment in the area of the upper limit of the holding temperature 750–800° C. The maximum cooling rate can be around 120° C./min in the area of the lower limit of the holding temperature 360–400° C. The said heat treatment can proceed at the temperature greater than 800° C. but only for a short holding time, which can be realized by increasing of the belt rate in the conveyer belt furnace, for instance. Such mode of the heat treatment should be experimentally examined to avoid the hard or brittle structure of iron-silicon article and allow the cold pressing operation.

As a result of investigations, the residual compression stresses became very small or even were eliminated totally due to heat treatment. It has been confirmed that a relatively big deformation of the article was obtained on the second cold pressing operation. Impregnation or lubrication of iron-silicon articles is carried out before the second cold pressing in order to enhance a hydrostatic pressure and provide a radial flow of the metal in open or closed dies. The impregnation provides a more substantial change of the shape in radial direction 2 (FIG. 2) than the lubrication.

The cold pressing is carried out with the same pressure from 20 to 50 tsi and allowed to reach the green density of iron-silicon article not less than 91% of the theoretical value (7.0 g/cc) just before the sintering. The relatively high ductility of the iron-silicon article body after said stress relieving heat treatment and partial bonding among iron/steel particles permits the use of cold automatic presses and regular tooling (dies and punches) without a risk to breaking. By this means, a new operation of the stress relieving heat treatment of iron or low carbon steel particles after first cold pressing is the practical solution of rising the green density of formed iron-silicon articles having intricate design up to 91% of the theoretical value without an intermediate sintering. This new operation also provides the ability of the porous metal to flow in radial direction 2 under the pressure applied along the article axis.

This level of density achieved after cold pressing operations will really allow to obtain a density greater than 96% of the theoretical value and improve the density distribution in the high temperature sintering operation, especially if it will be (entirely or partially) a liquid-phase sintering process that provides a greater shrinkage than a solid-phase sintering.

Figure 3:
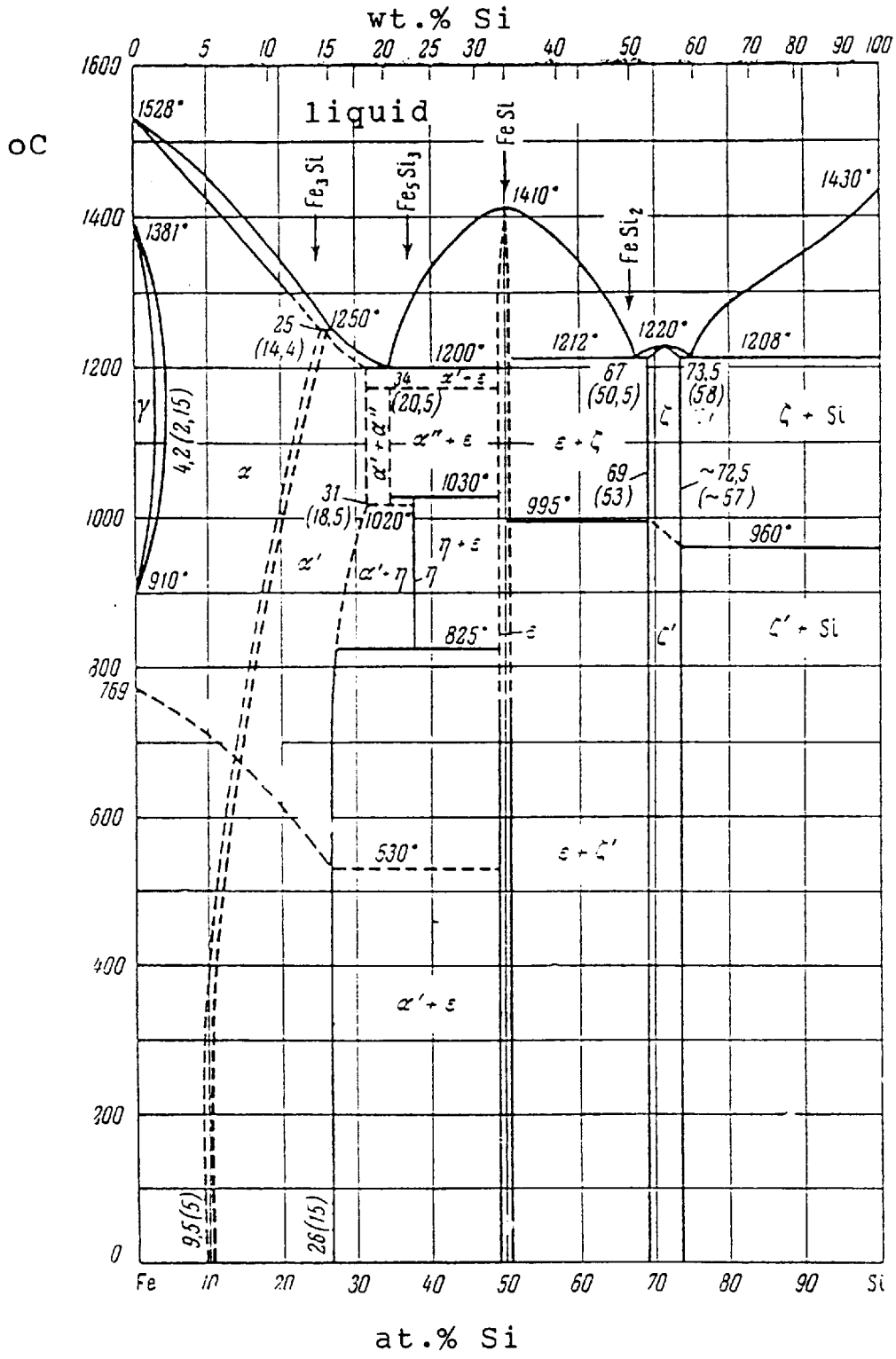
FIG. 3 shows a Fe—Si Phase Diagram.

The liquid-phase sintering of said iron-silicon articles is to be carried out at a temperature higher than 1230° C. as it is followed from the Fe—Si phase diagram in FIG. 3. But as we stated above, the diagram shows and the trials confirm that the liquid-phase sintering process occurs only during the initial minutes at the constant temperature. As the interaction between solid iron powder and silicon-rich liquid phase is being developed, the liquidus temperature of the molten alloy drastically increases, and further processing occurs as the solid-phase sintering which is characterized by substantially lower shrinkage. Moreover, the master alloy, that is usually used in the initial blend for the production of iron-silicon magnetic articles, has about 31 wt. % of silicon and consists of more than 50% of ϵ-phase (FeSi intermetallics) that is melted only at a temperature greater than 1410° C. If the constant sintering temperature is 1380° C., the solid-phase sintering process will begin later than at 1250° C. or at 1300° C., but it will occur.

In order to increase the shrinkage during the sintering and to obtain the greater final density of the iron-silicon articles, the present invention will improve the technology by changing the sintering temperature directly during the sintering operation. The sintering temperature is being elevated permanently from 1250 to 1420° C. This allows to increase the total time of a liquid-phase part of the sintering process and by this means to obtain a greater final density for the shorter time.

Besides, the proposed increase of the sintering temperature provides accelerated diffusion between silicon and iron because the diffusion coefficient of a dissolution of solid iron in the liquid iron-silicon phase is about $10^4$ times greater than the diffusion coefficient of a dissolution of solid silicon in the solid iron at the temperature range of 1200–1300° C. In other words, we conceptually improve the process increasing the temperature during trend of the sintering: firstly, we increase the shrinkage and final density of the article, secondly, we increase the rate and the uniformity of the distribution of silicon in the iron or low carbon steel body of the article.

The temperature elevation is carried out by several methods using the digital control programmer of the vacuum furnace: 1) the sintering temperature is being elevated with the rate about 1–3° C./min; 2) the sintering temperature is being elevated step by step every 8–12 minutes for 15–20° C. on each step; 3) the sintering operation of formed iron-silicon articles is carried out in two stages:

liquid-phase sintering at the temperature range of 1280–1300° C., and solid-phase sintering at the temperature range of 1300–1420° C.

The subject invention will now be described with reference to the following examples which are set forth for the purpose of illustrating the present invention and not for the purpose of limiting the same.

EXAMPLE 1

The iron-silicon sintered article having the density 7.45 g/cc (96.88% of the theoretical value) was made using, as the row materials, commercially available blend:

89±1 wt. % of low carbon steel powder comprising, by weight percent, less than 0.01 carbon, 0.15–0.20 manganese, 0.08–0.12 copper, 0.03–0.06 nickel, 0.08–0.12 chromium, and the balance of iron and incidental impurities of oxygen, nitrogen, phosphorus, silicon, and sulfur, 10±1 wt. % of iron-silicon master alloy powder comprising, by weight percent, 31±1 silicon, and the balance of iron and unavoidable impurities.

Figure 2:
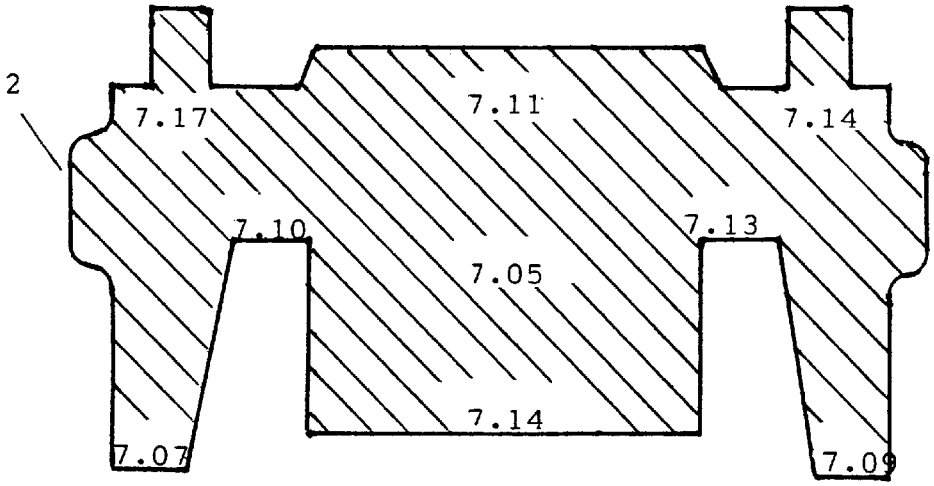
FIG. 2 shows the cross section of the same sample of formed iron-silicon article, radial change of the shape, and the distribution of the green density after the stress relieving heat treatment and second cold pressing operation.

This mixture was blended together with 1.25 wt. % of Acrowax (a lubricant) and Carbosil (an improving flow rate agent) in the ratio 10 g per 100 lbs of the blend. The apparent density of the blend was 3.06 g/cc, and the flow rate was 36 sec/50 g. The cold pressing of said blend was made in the rigid die with pressure approximately 30 tsi. The maximal green density obtained after the first cold pressing was 6.76 g/cc or 87.9% of the theoretical value but deviations from this value reached 0.45 g/cc (FIG. 1). Then, stress relieving heat treatment of the formed article was carried out during 40 minutes at the temperature 790±10° C. followed by a cooling at a rate about 30° C./min. After 20–25 minutes of this heat treatment, the temperature was increased to 920±10° C. for 10–15 minutes to intensify the diffusion interaction between low carbon steel particles and provide the formation of indissoluble connections between particles in the article body. Further increase of the article density was made by a second cold pressing operation in the open die under the same pressure approximately of 30 tsi. The impregnation by a synthetic oil was made before the pressing. The average green density of the article body 7.11±0.06 g/cc (92.46% of the theoretical value) was obtained after pressing (FIG. 2). Then, the sintering of the dense article was accomplished in a hydrogen atmosphere in the temperature range of 1250–1420° C. during which the temperature was being elevated progressively every 8–12 minutes for 15–20° C. The final density of the iron-silicon article 7.45 g/cc or 96.88% of the theoretical value was reached after sintering.

EXAMPLE 2

The iron-silicon sintered article having the density 7.41 g/cc (96.36% of the theoretical value) was made using, as the row materials, commercially available blend:

89±1 wt. % of low carbon steel powder comprising, by weight percent, less than 0.01 carbon, 0.15–0.20 manganese, 0.08–0.12 copper, 0.03–0.06 nickel, 0.08–0.12 chromium, and the balance of iron and incidental impurities of oxygen, nitrogen, phosphorus, silicon, and sulfur, 10±1 wt. % of iron-silicon master alloy powder comprising, by weight percent, 31±1 silicon, and the balance of iron and unavoidable impurities.

This mixture was blended together with 1.25 wt. % of Acrowax (a lubricant) and Carbosil (an improving flow rate agent) in the ratio 10 g per 100 lbs of the blend. The apparent density of the blend was 2.99 g/cc, and the flow rate was 35 sec/50 g. The cold pressing of said blend was made in the rigid die with pressure approximately 30 tsi. The maximal green density obtained after the first cold pressing was 6.60 g/cc or 85.8% of the theoretical value but deviations from this value ranged up to 0.37 g/cc . Then, stress relieving heat treatment of the formed article was carried out during 160–180 minutes at the temperature 360±10° C. followed by a cooling at a rate about 120° C./min. After 120–130 minutes of this heat treatment, the temperature was increased to 920±10° C. for 10–15 minutes to complete the formation of the continuous solid structure of the article body. Further increase of the article density was made by a second cold pressing operation in the closed die with the same pressure approximately 30 tsi. The lubrication in the synthetic oil occurred before pressing. The average green density of the article body 7.06±0.06 g/cc (91.8% of the theoretical value) was obtained after pressing. Then, the sintering of the article was accomplished in a hydrogen atmosphere in the temperature range of 1280–1420° C. during which the temperature was being elevated in two stages: at the temperature range of 1280–1300° C., and at the temperature range of 1300–1420° C. The final density of the iron-silicon article 7.41 g/cc or 96.36% of the theoretical value was reached after the sintering.

What is claimed is:

1. Method of producing high density sintered articles from iron-silicon alloys comprising:

(a) blending compressible iron or low-carbon steel powder, any one of silicon alloyed iron, silicon powder, or a combination of silicon alloyed iron and silicon powder, and a lubricant, to form a blended mixture, (b) cold pressing said blended mixture at a pressure less than 50 tsi to form a porous metal article with a density up to 88% of theoretical value, said article comprising hard powder consisting of silicon and/or silicon alloyed particles uniformly distributed among ductile iron or low carbon steel powder, (c) low temperature stress relieving heat treatment of said formed article at a temperature range of 360–800° C. followed by cooling at a cooling rate of less than 120° C./min to relieve compression stresses in said iron or low carbon steel particles inside said formed article, while avoiding substantial diffusion of silicon from said hard powder into said ductile iron or low carbon steel powder, (d) impregnating or lubricating said formed article to a degree sufficient to provide hydrostatic pressure and radial plastic flow of the porous metal in a subsequent pressing operation, (e) densifying said formed and stress relieved article by cold pressing to a density not less than 91% of theoretical value using the same pressure as in step (b), and finally (f) sintering the said formed article to obtain a density greater than 96% of theoretical value at an elevated temperature of from about 1250° C. to about 1420° C.

2. Method according to claim 1, comprising carrying out said stress relieving heat treatment for about 15–20 minutes at the temperature of 790±10° C., followed by a cooling rate of approximately 30° C./min.

3. Method according to claim 1, comprising carrying out said stress relieving heat treatment for about 160–180 minutes at the temperature of 360±10° C., followed by a cooling rate of approximately 120° C./min.

4. Method according to any one of claims 1, 2, or 3, wherein said stress relieving heat treatment comprises temporarily elevating the temperature above the temperature of $\alpha \rightarrow \gamma$ phase transformation of said iron or low carbon steel powder to enhance partial solid-phase bonding of the said powder, and then reducing the temperature below the temperature of the $\gamma \leftarrow \gamma$ phase transformation and continuing said stress relieving heat treatment.

5. Method according to claim 1, comprising progressively elevating the temperature of the sintering every 8–12 minutes by about 15–20° C.

6. Method according to claim 1, wherein the sintering comprises two stages:

liquid phase sintering at a temperature range of 1280–1300° C., and solid-phase sintering at a temperature range of 1300–1420° C.

7. Method according to claim 1, wherein the initial blend composition contains:

89±1 wt. % of low carbon steel powder comprising, by weight percent, less than 0.01 carbon, 0.15–0.20 manganese, 0.08–0.12 copper, 0.03–0.06 nickel, 0.08–0.12 chromium, and the balance of iron and incidental impurities of oxygen, nitrogen, phosphorus, silicon, and sulfur, and 10±1 wt. % of iron-silicon master alloy powder comprising, by weight percent, 31±1 silicon, and the balance of iron and unavoidable impurities.

8. Method according to claim 1, wherein the initial blend composition contains:

89±1 wt. % of low carbon steel powder comprising, by weight percent, less than 0.01 carbon, less than 0.10 manganese, 0.08–0.12 copper, less than 0.1 chromium, less than 0.06 nickel, and the balance of iron and incidental impurities of oxygen, nitrogen, phosphorus, silicon, and sulfur, and 10±1 wt. % of iron-silicon master alloy powder comprising, by weight percent, 31±1 silicon, and the balance of iron and unavoidable impurities.

9. Method according to claim 1, wherein said blending step further comprises adding a flow rate improving agent.

* * * * *